US006954719B2

(12) United States Patent
Carter, Jr. et al.

(10) Patent No.: US 6,954,719 B2
(45) Date of Patent: Oct. 11, 2005

(54) WORK SITE DUST CONTROL SYSTEM

(75) Inventors: Jeffery J. Carter, Jr., Peoria, IL (US); Robert A. Herold, Peoria, IL (US); Kelsey L. Milman, Morton, IL (US); Michael M. Payne, Peoria, IL (US); Mark B. Rinkel, Edelstein, IL (US)

(73) Assignee: Caterpillar Inc, Peoria, IL (US)

( * ) Notice: Subject to any disclaimer, the term of this patent is extended or adjusted under 35 U.S.C. 154(b) by 28 days.

(21) Appl. No.: 10/662,592

(22) Filed: Sep. 15, 2003

(65) Prior Publication Data

US 2005/0060127 A1 Mar. 17, 2005

(51) Int. Cl.[7] ..... G06F 11/00; G06F 19/00; G01C 17/00

(52) U.S. Cl. ..... 702/188; 702/150; 700/245; 700/258

(58) Field of Search ..... 702/188, 150, 702/155, 158; 700/245, 258, 262; 701/23; 901/1, 46; 706/905

(56) References Cited

U.S. PATENT DOCUMENTS 3,867,640 A 2/1975 Paulsen
4,380,353 A 4/1983 Campbell et al.
4,552,487 A 11/1985 Weirich
4,642,196 A 2/1987 Yan
4,714,293 A 12/1987 Watson
4,993,838 A 2/1991 Tresouthick et al.
5,330,671 A 7/1994 Pullen et al.
5,959,423 A * 9/1999 Nakanishi et al. ..... 318/568.12
6,087,947 A 7/2000 Hamburger et al.
6,532,404 B2 * 3/2003 Colens ..... 700/262

* cited by examiner

*Primary Examiner*—John Barlow
*Assistant Examiner*—Meagan S Walling
(74) *Attorney, Agent, or Firm*—Deric J. Barnes; Finnegan, Henderson, Farabow, Garret & Dunner

(57) ABSTRACT

A method and system for controlling work site dust conditions are provided. The method may include providing a mobile dust control machine configured to treat a dust condition within a work location. The dust control machine may be disposed distant from the work location. The method may further include monitoring a dust condition of the work location, generating a dust control signal in response to monitoring the dust condition, dispatching the mobile dust control machine to the work location in response to the dust control signal, and operating the mobile dust control machine at the work location.

30 Claims, 1 Drawing Sheet

WORK SITE DUST CONTROL SYSTEM

TECHNICAL FIELD

The present invention relates generally to the control of work site dust conditions and, more particularly, to the application of one or more dust control machines to treat work site dust conditions.

BACKGROUND

In various industries, such as the mining industry and the construction industry, work site operations may occur within or may cause undesirable dust conditions. For example, cutting or other mining operations at a mining site may significantly increase dust levels at the site. Such increased dust levels may cause undesirable conditions, such as impaired visibility within the site, diminished work machine performance, and increased frequency of work machine maintenance. Moreover, such dust levels may create uncomfortable work conditions for work personnel.

Various devices and methods have been used in the past to control work site dust conditions. For example, U.S. Pat. No. 4,714,293 discloses a dust control apparatus for use at a mining site during operation of a cutting tool. The apparatus includes means for dispersing pressurized water toward the cutting tool during a cutting operation.

U.S. Pat. No. 4,380,353 discloses a method for controlling dust generated by the operation of mining equipment. The method includes using a fan to remove dust-laden air from the vicinity of a work operation during performance of the work operation, directing the dust-laden air through a passage, using water to scrub dust from the air as it flows through the passage, separating dust-laden water droplets from the air, and disposing of the dust-laden droplets.

Another method of controlling work site dust conditions includes using a water truck to spray water generally about a work site. Such a water truck typically roams a work site from one work location to another, often over or under treating the work site.

Prior methods of controlling work site dust conditions may suffer from various disadvantages. For example, prior methods may focus dust treatment measures at a particular work location only during the performance of a disruptive work operation, such as a cutting operation. Thus, prior methods may not sufficiently prevent or otherwise control dust conditions at a work location when disruptive work operations are not occurring. Moreover, prior methods may not effectively or efficiently deploy dust control equipment throughout a work site. For example, prior methods may not effectively manage dust treatment operations among multiple work locations, nor effectively manage the deployment of multiple dust control machines. Further, prior methods may cause inefficient treatment of dust conditions, for example by over or under treating a work site.

The present invention is directed to overcoming one or more disadvantages associated with prior dust control devices and methods.

SUMMARY OF THE INVENTION

In one embodiment of the present invention, a method for controlling work site dust conditions is provided. The method may include providing a mobile dust control machine configured to treat a dust condition within a work location. The dust control machine may be disposed distant from the work location. The method may further include monitoring a dust condition of the work location, generating a dust control signal in response to monitoring the dust condition, dispatching the mobile dust control machine to the work location in response to the dust control signal, and operating the mobile dust control machine at the work location.

In another embodiment of the present invention, a dust control system for controlling work site dust conditions is provided. The system may include a dust monitor disposed and arranged to monitor a dust condition of a work location and being operable to produce a dust control signal. The system may further include a mobile dust control machine configured to treat a dust condition within the work location, the dust control machine being movable to the work location from a position distant from the work location in response to the dust control signal.

It is to be understood that both the foregoing general description and the following detailed description are exemplary and explanatory only and are not restrictive of the invention, as claimed.

BRIEF DESCRIPTION OF THE DRAWING

The accompanying drawing, which is incorporated in and constitutes a part of this specification, illustrates exemplary embodiments or features of the invention and, together with the description, serves to explain the principles of the invention. In the drawing.

Figure 1:
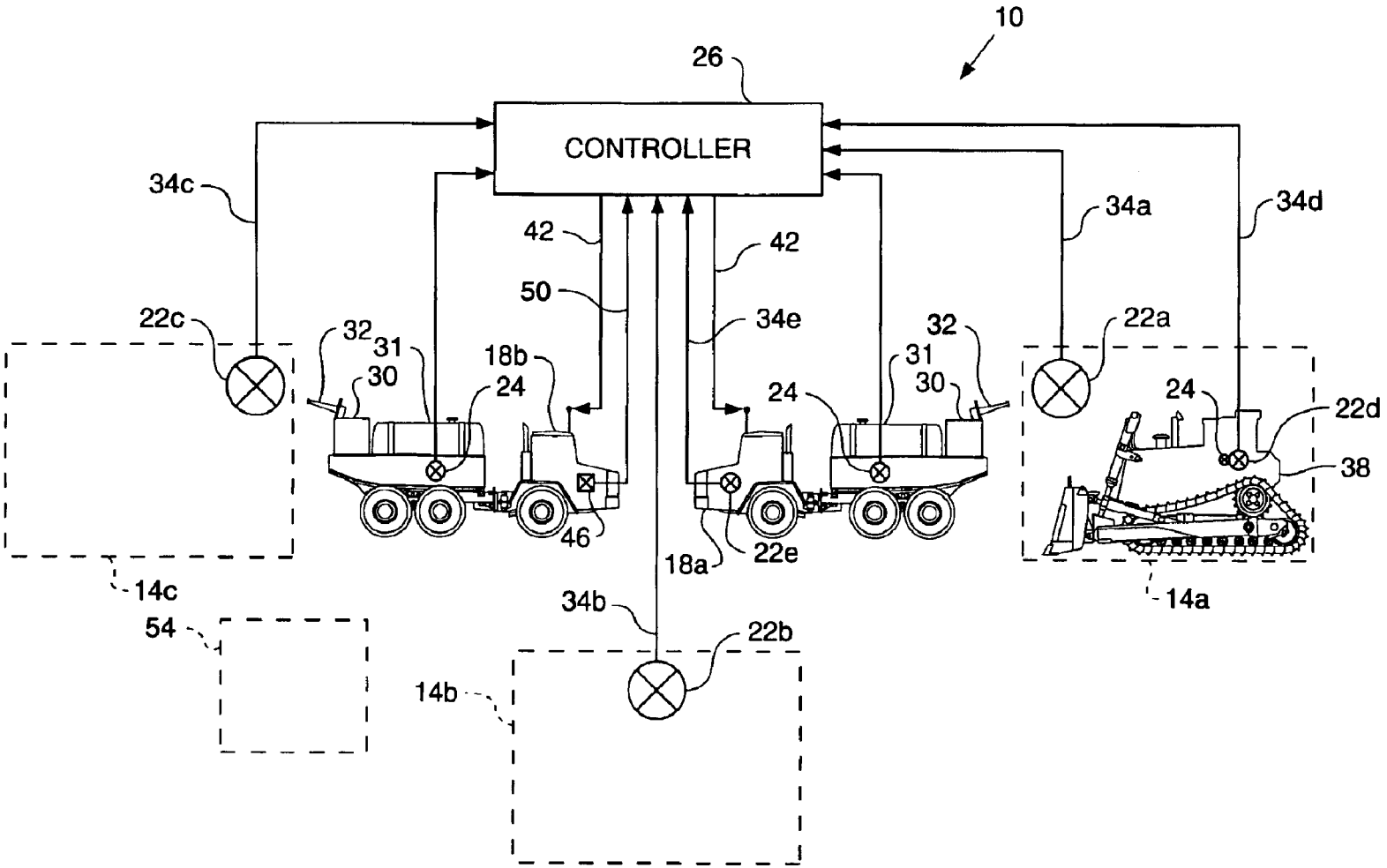
FIG. 1 is a diagrammatic illustration of an exemplary dust control system.

Although the drawing depicts exemplary embodiments or features of the present invention, the drawing is not necessarily to scale, and certain features may be exaggerated in order to better illustrate and explain the present invention. The exemplifications set out herein illustrate exemplary embodiments or features of the invention and such exemplifications are not to be construed as limiting the scope of the invention in any manner.

DETAILED DESCRIPTION

Reference will now be made in detail to embodiments or features of the invention, examples of which are illustrated in the accompanying drawing. Wherever possible, the same or corresponding reference numbers will be used throughout the drawing to refer to the same or corresponding parts.

Referring to FIG. 1, an exemplary dust control system 10 is shown. The dust control system 10 may be used to control dust conditions within one or more work locations 14*a*, 14*b*, 14*c*. The dust control system 10 may include one or more mobile dust control machines 18*a*, 18*b*, one or more dust monitors 22*a*, 22*b*, 22*c*, and a controller 26.

In one embodiment of the present invention, a work site may be divided into one or more work locations 14*a*, 14*b*, 14*c* or zones. It should be appreciated that the work locations 14 may be proximate each other or may, alternatively or additionally, be distant from each other.

Each mobile dust control machine 18 may be configured to treat a dust condition within one or more work locations 14 and may include dust control equipment 30. The dust control equipment 30 may comprise, for example, any of a variety of dust control devices known in the art. An exemplary arrangement of dust control equipment 30 may include a water reservoir 31, a water pump (not shown), and a spray nozzle 32 for delivering pressurized water to a desired work location 14. A variety of known water spray techniques may be used to reduce dust levels at a work location 14. It should be appreciated that alternative or additional types of dust control equipment 30 and/or techniques known in the art may be used with the dust control system 10 disclosed herein.

Each dust control machine 18 may be movable to and from one or more work locations 14. For example, a dust control machine 18 may comprise a mobile work truck including a steering mechanism (not shown) and being movable to a desired location by work personnel. In one embodiment, a dust control machine 18 may be a remote-controlled work vehicle capable of traversing a work area. It should be appreciated that alternative or additional types of dust control machines 18 known in the art may be used in accordance with the present invention.

One or more work locations 14*a*, 14*b*, 14*c* may be monitored, for example by a dust monitor 22*a*, 22*b*, 22*c*, to determine dust conditions at the work location 14*a*, 14*b*, 14*c*. For example, a dust monitor 22*a* positioned at or proximate a work location 14*a* may include dust monitoring equipment. In one embodiment, a dust monitor 22*a* may be operable to sample air at the work location 14*a* to determine a dust condition at the work location 14*a*, such as a dust level at the work location 14*a*. An exemplary dust monitoring technique may include using dust monitoring equipment to collect dust-laden air from the work location 14*a*, using a constant intensity light source to pass light through the dust-laden air toward a light sensor, and measuring the magnitude of light transmission interference between the light source and the light sensor. The magnitude of the interference may be used to indicate the density of dust contained in the air. It should be appreciated that alternative or additional types of dust monitoring devices or methods known in the art may be used with the dust control system 10.

Each dust monitor 22*a*, 22*b*, 22*c* may be operable to produce a dust control signal 34*a*, 34*b*, 34*c* indicative of a dust condition at a work location 14*a*, 14*b*, 14*c*. In one embodiment, a dust control signal 34 may comprise a radio frequency type signal, an electrical type signal, or other type signal indicative, for example, of a level of dust present at a work location 14. Moreover, a dust monitor 22 may be operable to transmit a dust control signal 34 that is proportional to the level of dust present at the corresponding work location 14. Alternatively or additionally, the dust control signal 34 may comprise a signal indicating that the level of dust in the work location 14 is above, or is predicted to rise above, a reference dust level—e.g., a desired, undesired, optimum, minimum, or maximum dust level, for example. Moreover, a dust control signal 34 may comprise a signal indicating that the level of dust in the work location 14 is below, or is predicted to fall below, a reference dust level. The reference dust level may be, for example, a predetermined dust level in accordance with federal, state, or local laws or regulations. Alternatively or additionally, the reference dust level may be a subjectively or objectively determined dust level that may be predetermined or determined in real time by work personnel. Further, a dust monitor 22 may be configured to monitor a dust condition at a work location 14 periodically, continuously, selectively, when activated by work personnel, or according to any of a variety of time intervals, conditions, or sampling techniques.

Each dust monitor 22 may be configured to transmit a dust control signal 34 independent of, or in one embodiment in lieu of, its dust monitoring function. For example, a dust monitor 22 may, alternatively or additionally, be configured to allow work personnel to cause the dust monitor 22 to transmit a dust control signal 34 manually or automatically. In one exemplary embodiment, a dust monitor 22 may have controls (not shown) that may be manually operated by work personnel to produce a desired dust control signal 34. Thus, a dust condition, or an expected dust condition, of a work location 14 may be determined by work personnel, who may cause the dust monitor 22 to generate a corresponding dust control signal 34.

It should be appreciated that when a plurality of dust monitors 22*a*, 22*b*, 22*c* are used, the dust monitors may be configured to monitor their respective work locations 14*a*, 14*b*, 14*c* independently, simultaneously, consecutively, or in any other desired manner. Moreover, the dust monitors 22*a*, 22*b*, 22*c* may be mounted in fixed locations or positions or may be movable to a variety of positions or work locations 14*a*, 14*b*, 14*c*.

In one embodiment, a dust monitor 22*d* may be mounted on a work machine 38—such as a track-type tractor, a grading machine, a paving machine, a dust control machine, or the like—that is positioned within or movable to a work location 14*a*. Further, the dust monitor 22*d* may be movable from one work location 14 to another, for example, along with the work machine 38 if the work machine 38 is a mobile work machine. When mobile dust monitors 22*d* are used, each mobile dust monitor 22*d* may be associated with locating equipment 24 such as a Global Positioning System (GPS) for example, so that the position of the dust monitor 22*d* may be tracked, such as by the controller 26, and associated with an appropriate work location 14*a*.

In one embodiment, a mobile dust monitor 22*e* may be mounted to a dust control machine 18*a*. In such an embodiment, the dust monitor 22*e* may be used to determine dust conditions proximate the dust control machine 18*a*, for example within a work location 14 in which the dust control machine 18*a* is performing dust treatment operations.

In an embodiment where fixed location dust monitors 22 are used, each fixed location dust monitor 22 may be configured and arranged to monitor more than one work location 14. For example, a dust monitor 22 may be arranged proximate two or more work locations 14 such that monitoring of multiple work locations 14 may be accomplished with a single dust monitor 22. Such a dust monitor 22 may be operable to transmit dust control signals corresponding to and distinguishing the dust conditions of the respective monitored work locations 14.

Referring again to FIG. 1, the dust control system 10 may include one or more controllers 26. A controller 26 may include a computer processor and/or other electrical control componentry. Moreover, the controller 26 may be operable to communicate with one or more dust monitors 22. For example, the controller 26 may be configured and arranged to communicate with the dust monitors 22 by wireless communication means, such as by satellite, cellular, or radio frequency technology, which means are generally well known. Alternatively or additionally, the controller 26 may communicate with the dust monitors 22 by other means, such as a modem having access to public telephone lines. Alternatively or additionally, the controller 26 may communicate with the dust monitors 22 via wired communication means, such as a wired system connecting the dust monitors 22 and the controller 26. It should be appreciated that additional or alternative communication means may be used between the controller 26 and the dust monitors 22 in accordance with the present invention. It should further be appreciated that a controller 26 may be positioned at a variety of locations, such as on a dust control machine 18, within or adjacent a dust monitor 22, or distant from all dust control machine(s) 18 and/or dust monitor(s) 22, for example.

The controller 26 may be operable to receive one or more dust control signals 34*a*, 34*b*, 34*c*, 34*d* from one or more dust monitors 22*a*, 22*b*, 22*c*, 22*d*, 22*e* via the communication means. The controller 26 may use the dust control signals 34 to produce one or more dispatch signals 42 for dispatching (e.g., deploying) one or more of the dust control machines 18 to one or more work locations 14. For example, the controller 26 may respond to the one or more control signals 34 by determining that a particular mobile dust control machine 18*a* should be dispatched to a particular work location 14*a*, and may therefore produce a dispatch signal 42 for dispatching the appropriate dust control machine 18*a* to that work location 14*a*.

It should be appreciated that a dust control signal 34 received by the controller 26 may indicate a specific dust level within a specific work location 14, and the controller 26 may be operable to compare the indicated dust level to a reference dust level or dust condition to determine whether dust treatment operations within the specific work location 14 are warranted. Similarly, a plurality of dust control signals 34 received by the controller 26 over a period of time may be evaluated by the controller 26 to identify a dust level trend within the specific work location 14, and the controller 26 may be operable to compare the trend to a reference dust level or trend to determine whether dust treatment operations within the specific work location 14 are warranted. Alternatively or additionally, a dust control signal 34 itself may indicate that a dust level, or a dust level trend over a period of time, within a work location 14 is above, below, substantially equal to, or bears some other relationship to a reference dust level or dust condition such that dust treatment operations within the work location 14 are warranted. In any case, the controller 26 may respond to the dust control signal or signals 34 by producing a dispatch signal 42 for dispatching a dust control machine 18 to or away from a work location 14, as appropriate. Similarly, the controller 26 may respond to the dust control signal or signals 34 to cancel a dispatch signal 42 or otherwise terminate a dust treatment operation when the dust control signal or signals 34 indicate that a dust condition at a work location 14 has been sufficiently treated or otherwise sufficiently changes. For example, after a dust control machine 18 has been dispatched to and has performed dust treatment operations within a specified work location 14, a dust monitor 22 at the work location 14 or onboard the dust control machine 18 may indicate that dust conditions within the work location 14 have been sufficiently treated. Thereafter, the dust control machine 18 may move to the next work location 14 on its dispatch route, or, alternatively, the dust control machine 18 may be immediately dispatched to a different work location 14 by the controller 26.

A dispatch signal 42 may comprise, for example, an electrical type or other type signal that is communicated to a dust control machine 18 or to an operator that is operating the dust control machine 18. For example, the dust control machine 18 may include a visual operator display (not shown), and the dispatch signal 42 may be automatically communicated by the controller 26 to the operator display via a communication means, such as one of the communication means discussed above. The dispatch signal 42 may be transmitted to the operator display to provoke or instruct a machine operator to move the dust control machine 18 to a specific work location 14 to perform a dust treatment operation.

In an alternative embodiment, a dispatch signal 42 may comprise a visual or audible indication at the controller 26, at a dispatch station (not shown), or at some other location distant from the work location 14 and/or the dust control machine 18. For example, the indication may indicate to a human dispatcher disposed distant from the dust control machine 18 and/or distant from a work location 14 that a dust control machine 18 should be dispatched to one or more specific work locations 14. The human dispatcher may respond to the indication by dispatching a dust control machine 18 to the specified work location(s) 14. For example, the human dispatcher may call the operator of a dust control machine 18 and instruct the operator to transport the dust control machine 18 to the specified work location(s) 14.

In one embodiment, a controller 26 may receive a dust control signal 34 from a dust monitor 22 indicating that a dust level within a work location 14 is above a reference dust level. In another embodiment, the controller 26 may receive a plurality of dust control signals 34 from the dust monitor 22 over a period of time indicating that the dust level within the work location 14 will likely exceed a reference dust level if dust treatment is not performed. In either case, the controller 26 may issue a dispatch signal 42 for dispatching a mobile dust control machine 18 to the corresponding work location 14. Thus, the mobile dust control machine 18 may be dispatched to the work location 14 to perform a dust treatment operation within the work location 14, thereby suppressing or otherwise controlling a dust condition within the work location 14.

The controller 26 may be operable to receive multiple dust control signals 34 from one or more dust monitors 22 indicating dust conditions at multiple work locations 14. The controller 26 may be operable to evaluate and compare the indicated dust conditions of the respective work locations 14 and to use the comparison to produce one or more appropriate dispatch signals 42 for dispatching one or more dust control machines 18 to one or more work locations 14. For example, the controller 26 may be operable to determine which of the monitored work locations 14 have the highest dust levels and to produce one or more dispatch signals 42 in accordance with the determination. Moreover, the controller 26 may be operable to evaluate the indicated dust conditions of the respective work locations 14 and to determine a dispatch route for at least one of the dust control machines 18 based on the evaluation. In one embodiment, the controller 26 may be operable to compare dust control signals 34*a*, 34*b*, 34*c* of multiple work locations 14*a*, 14*b*, 14*c* and to dispatch a dust control machine 18*a* in sequence to each of the work locations 14*a*, 14*b*, 14*c* by giving dispatch priority to work locations having higher dust levels.

In one example, the controller 26 may receive dust control signals 34*a*, 34*b*, 34*c* from multiple dust monitors 22*a*, 22*b*, 22*c* indicative of dust conditions within multiple work locations 14*a*, 14*b*, 14*c*. The controller may be operable to evaluate these signals 34*a*, 34*b*, 34*c* to determine (1) that a first work location 14*a* has the highest dust level, (2) that a second work location 14*b* has the second highest dust level, and (3) that the dust conditions of the first and second work locations 14*a*, 14*b* warrant dust treatment operations in those locations 14*a*, 14*b*. In response to the determination, the controller 26 may produce one or more dispatch signals 42 for dispatching a dust control machine 18*a* first to the first work location 14*a* and subsequently to the second work location 14*b*. Thus, the controller 26 may be operable to produce dispatch signal(s) 42 to indicate a desired (e.g., the most efficient or otherwise most effective) dispatch route for the dust control machine 18*a*. Alternatively or additionally, the controller 26 may produce one or more dispatch signals 42 for dispatching a first one of the dust control machines

18*a* to the first work location 14*a* and for dispatching a second one of the dust control machines 18*b* to the second work location 14*b*.

In accordance with the present invention, the locations of the mobile dust control machines 18 may be monitored. For example, GPS or other location monitoring equipment 24 may be provided on the mobile dust control machines 18. Moreover, the locations of the mobile dust control machines 18 may be determined and communicated to the controller 26 via communication means, such as the communication means described above. In one embodiment of the present invention, the controller 26 may be operable to evaluate the location of a first dust control machine 18*a* relative to a work location 14*a* (or work locations) and/or relative to a second dust control machine 18*b* (or machines) and to produce a dispatch signal 42 for dispatching the dust control machine 18*a* to the work location 14*a* in response to the evaluation. For example, the controller may be operable to determine (1) that a dust condition at the work location 14*a* requires treatment, and (2) that the first dust control machine 18*a* is closer to the first work location 14*a* than is the second dust control machine 18*b*. Thus, the controller 26 may be operable to produce a dispatch signal 42 for dispatching the first dust control machine 18*a* (rather than the second dust control machine 18*b*) to the first work location 14*a*, thereby reducing overall travel distance and/or travel time for the dust control machines 18*a*, 18*b* and potentially reducing overall fuel consumption of the dust control machines 18*a*, 18*b*.

Similarly, when multiple work locations 14 are being monitored, the controller 26 may be operable to evaluate and compare potential routes for a dust control machine 18 (or machines) and to produce one or more dispatch signals 42 indicating a preferred route (or routes) for the dust control machine(s) 18, for example by evaluating or estimating (and potentially minimizing) total estimated travel time, fuel consumption, and/or travel distance for the dust control machine(s) 18 and/or by evaluating dust conditions within the work locations 14. For example, the controller 26 may be operable to determine (1) that dust conditions within three work locations 14*a*, 14*b*, 14*c* warrant dust treatment operations; (2) that total travel distance and/or work time of two dust control machines 18*a*, 18*b* may be minimized by (a) dispatching the first dust control machine 18*a* first to the first work location 14*a* and subsequently to the second work location 14*b* and by (b) dispatching the second dust control machine 18*b* to the third work location 14*c*. Thus, a controller 26 may be operable to evaluate information regarding: (i) dust conditions within one or more work locations 14; (ii) the locations(s) of one or more dust control machines 18; and/or (iii) the location(s) of one or more work locations 14, and to dispatch one or more dust control machines 18 to the location(s) 14 in response to the evaluated information.

In a further embodiment, a dust control machine 18*b* may include one or more resource status indicators 46 for indicating a status of one or more resources onboard the dust control machine 18*b*. For example, a resource status indicator 46 may be operable to indicate the amount of fuel available for consumption onboard the dust control machine 18*b*, and/or the resource status indicator may be operable indicate the amount of dust control resources (e.g., water) available onboard the dust control machine 18*b*. Moreover, the resource status indicator(s) 46 may be operable to transmit resource status signals 50 to a controller 26, and the controller 26 may be operable to evaluate the resource status signals 50 in order to more effectively dispatch one or more dust control machines 18. For example, the controller 26 may be operable to evaluate the amount of resources available to one or more dust control machines 18 in order to effectively dispatch the dust control machine(s) 18.

In one embodiment, a controller 26 may be operable to evaluate: (i) the amount of fuel available for use onboard one or more dust control machines 18; (ii) the amount of dust control resources (e.g., water) available onboard one or more dust control machines 18; (iii) the location(s) of one or more dust control machines 18 with respect to one or more work locations 14; and/or (iv) dust condition(s) at one or more work locations 14. The controller 26 may be operable to use this evaluation in order to effectively dispatch one or more dust control machines 18 to the one or more work locations 14. For example, the controller 26 may be operable to: (a) determine a dust condition (e.g., dust level) at a work location 14*a*; (b) calculate or otherwise estimate the amount (and/or flow rate) of dust control resources (e.g., water) required to effectively treat the dust condition (for example, using lookup tables, software, or other tools known in the art for such calculations); (c) determine the amount of fuel necessary to transport a dust control machine 18*b* (or machines) to the work location 14*a* (for example as a function of the fuel efficiency of the machine 18*b* and the distance between the dust control machine 18*b* and the work location 14*a*) and; (d) determine whether the dust control machine 18*b* (or machines) has sufficient onboard resources available (e.g., fuel, water) to travel to the work location 14*a* and/or to effectively treat the dust condition at the work location 14*a*; and (e) dispatch the dust control machine 18*b* (or machines) to the work location 14*a* as a result of these determinations. Thus, the controller 26 may be operable to evaluate all information being transmitted to it regarding one or more dust control machines 18 and one or more work locations 14 and to use this evaluation to effectively dispatch the dust control machine(s) to the work location(s)—for example by dispatching the dust control machine(s) along one or more routes that minimizes travel time, work time, fuel consumption, and/or other work factors. For example, the controller 26 may dispatch a first dust control machine 18*b* to a work location 14*a* even though a second dust control machine 18*a* is closer to the work location 14*a* if the second dust control machine 18*a* does not have sufficient resources (e.g., fuel or water) to travel to the work location 14*a* and completely treat the work location 14*a*.

It should be appreciated that a controller 26 may be operable to evaluate a dust control machine's onboard resources and, in response to this evaluation, dispatch the dust control machine 18 to a refill location 54 so that the dust control machine 18 may refill its onboard resources. Moreover, a controller 26 may be operable to dispatch a relief dust control machine 18*b* to a work location 14*a* if, for example during the course of treating the work location 14*a*, a first dust control machine 18*a* exhausts or is likely to exhaust its onboard resources (e.g., water or fuel) before fully treating the work location 14*a*. In addition, the controller 26 may be operable to dispatch one or more dust control machines 18 to one or more work locations 14 that may benefit from dust treatment operations in order to maximize the use of (e.g., deplete or nearly deplete) the dust control machine's 18 resources before dispatching the dust control machine 18 to a refill location 54, a maintenance location, or other location for refilling, scheduled maintenance, or other downtime activity.

It should be appreciated that a dust control machine 18*a* may be operable to treat an intermediate work location 14 en route to a high priority work location 14*a* to which the dust control machine 18*a* has already been dispatched. For example, if a dust control machine 18*a* is en route to a high priority work location 14*a* and a mobile dust monitor 22*e* onboard the dust control machine 18*a* indicates that dust treatment operations are warranted at a work location 14 along the dust control machine's present path, the dust control machine 18*a* may perform dust treatment operations (for example in response to a new dispatch signal 42 from the controller 26) along its present path while en route to the high priority work location 14*a*.

It should be appreciated that a dust monitor 22 may incorporate a controller 26 and may be operable to produce one or more dispatch signals 42 in response to monitoring a dust condition of a work location 14. It should further be appreciated that such dust monitor may be operable to receive one or more dust control signals 42 from one or more other dust monitors 22 and to provide all of the functions described above with respect to a controller 26.

Operation of the system 10 may be controlled by software that is programmed into the controller 26 and/or various other components of the system 10. Alternatively or additionally, operation of the system 10 may be implemented via hardware or any other known programming or operating technique. Creation of appropriate software based upon the description set forth herein is within the capabilities of one having ordinary skill in the programming arts.

Industril Applicability

The present invention provides an improved system 10 and method for controlling work site dust more efficiently and effectively than prior systems and methods.

According to the present invention, one or more dust control machines 18 may be selectively dispatched in real time among work locations 14 only when and where dust treatment operations are needed. For example, the present invention may be used to dispatch dust control machines 18 automatically to a work location 14 when dust levels at the work location 14 exceed, or are likely to exceed, a reference dust level. In addition, the present invention may provide a method for evaluating dust conditions at a plurality of work locations 14 and selectively dispatching one or more dust control machines 18 as appropriate, for example to one or more work locations 14 where dust control operations are more severely needed. Further, the present invention may provide a method for dispatching a dust control machine 14 to one or more work locations 14 according to the position of the dust control machine 18 relative to the work location(s) 14 and/or relative to other dust control machine(s) 18. Moreover, the present invention may provide a method for dispatching a dust control machine 14 to one or more work locations 14 according to the status of resources onboard the work machine 14 and/or according to the status of resources onboard another work machine 14. As a result of these and other features of the present invention, fuel, water, and other dust control resources may be used more efficiently and effectively, and dust treatment operations may be more effectively controlled.

From the foregoing it will be appreciated that, although specific embodiments of the invention have been described herein for purposes of illustration, various modifications may be made without deviating from the spirit or scope of the invention. Other embodiments of the invention will be apparent to those skilled in the art from consideration of the specification and figures and practice of the invention disclosed herein. It is intended that the specification and disclosed examples be considered as exemplary only, with a true scope and spirit of the invention being indicated by the following claims and their equivalents. Accordingly, the invention is not limited except as by the appended claims.

What is claimed is:

1. A method for controlling work site dust conditions, the method comprising:

providing a mobile dust control machine configured to treat a dust condition within a work location, the dust control machine being disposed distant from the work location;

providing a dust monitoring device at the work location;

monitoring a dust condition of the work location with the dust monitoring device;

generating a dust control signal in response to monitoring the dust condition;

dispatching the mobile dust control machine to the work location in response to the dust control signal; and operating the mobile dust control machine at the work location.

2. The method of claim 1, further comprising:

providing a mobile dust condition monitor, the mobile dust condition monitor being disposed distant from the work location;

moving the mobile dust condition monitor into a position suitable for monitoring the dust condition of the work location; and using the mobile dust condition monitor to monitor the dust condition of the work location.

3. The method of claim 1, further comprising:

analyzing one or more dust control signals over a period of time; and dispatching the mobile dust control machine to the first work location in response to the analysis.

4. The method of claim 1, further comprising:

monitoring the location of the mobile dust control machine; and dispatching the mobile dust control machine to the work location in response to monitoring the location of the mobile dust control machine.

5. The method of claim 1, further including terminating the operation of the mobile dust control machine at the work location in response to a determination that the work location has been sufficiently treated.

6. The method of claim 1, further comprising:

monitoring the status of a resource onboard the dust control machine; and dispatching the mobile dust control machine to a location in response to monitoring the status of the resource.

7. The method of claims 6, wherein the step of dispatching the mobile dust control machine to a location in response to monitoring the status of the resource includes dispatching the mobile dust control machine to a refill or maintenance location.

8. The method of claim 6, wherein the step of dispatching the mobile dust control machine to a location in response to monitoring the status of the resource includes dispatching the mobile dust control machine to the work location.

9. A method for controlling work site dust conditions, the method comprising:

providing a mobile dust control machine configured to treat a dust condition within a work location, the dust control machine being disposed distant from the work location;

monitoring a dust condition of the work location;

generating a dust control signal in response to monitoring the dust condition;

dispatching the mobile dust control machine to the work location in response to the dust control signal;

operating the mobile dust control machine at the work location;

wherein the work location is a first one of a plurality of work locations;

the dust control signal is a first dust control signal; and the method further comprises:

monitoring the dust condition of a second work location; and generating a second dust control signal in response to monitoring the dust condition of the second work location.

10. The method of claim 9, further comprising:

communicating the first and second dust control signals to a controller; and generating a dispatch signal for dispatching the mobile dust control machine to the first work location.

11. The method of claim 9, further comprising:

moving a mobile dust condition monitor from one of the first and second work locations to the other.

12. The method of claim 9, wherein the dust conditions of the first and second work locations are monitored simultaneously.

13. The method of claim 9, further comprising:

comparing the first and second dust control signals; and dispatching the mobile dust control machine to the first work location in response to the comparison.

14. The method of claim 9, further comprising:

comparing the first and second dust control signals; and using the comparison to determine a dispatch route for the mobile dust control machine.

15. The method of claim 9, further comprising:

monitoring the position of the mobile dust control machine;

evaluating the positions of the mobile dust control machine, the first work location, and the second work location with respect to each other; and using the evaluation to determine a dispatch route for the mobile dust control machine.

16. The method of claim 9, wherein:

the mobile dust control machine is the first of a plurality of mobile dust control machines; and the method further comprises:

providing a second mobile dust control machine;

monitoring the locations of the first and second mobile dust control machines;

evaluating the locations of the first and second mobile dust control machines; and using the evaluation to determine a dispatch route for the first mobile dust control machine.

17. The method of claim 9, further comprising:

analyzing one or more first dust control signals over a period of time;

analyzing one or more second dust control signals over a period of time; and dispatching the mobile dust control machine to the first work location in response to the analyses.

18. A method for controlling work site dust conditions, the method comprising:

providing a mobile dust control machine configured to treat a dust condition within a work location, the dust control machine being disposed distant from the work location;

monitoring a dust condition of the work location;

generating a dust control signal in response to monitoring the dust condition;

dispatching the mobile dust control machine to the work location in response to the dust control signal;

operating the mobile dust control machine at the work location;

wherein the mobile dust control machine is the first of a plurality of mobile dust control machines; and the method further comprises:

providing a second mobile dust control machine configured to treat a dust condition within the work location, the second mobile dust control machine being disposed distant from the work location;

monitoring the locations of the first and second mobile dust control machines;

comparing the locations of the first and second mobile dust control machines; and using the comparison to dispatch the first mobile dust control machine to the first work location.

19. A method for controlling work site dust conditions, the method comprising:

providing a mobile dust control machine configured to treat a dust condition within a work location, the dust control machine being disposed distant from the work location;

monitoring a dust condition of the work location;

generating a dust control signal in response to monitoring the dust condition;

dispatching the mobile dust control machine to the work location in response to the dust control signal;

operating the mobile dust control machine at the work location;

wherein the work location is a first work location; and the method further comprises:

monitoring a dust condition of a second work location;

generating a second dust control signal in response to monitoring the dust condition of the second work location;

dispatching the mobile dust control machine to the second work location in response to the second dust control signal; and operating the mobile dust control machine at the second work location.

20. A method for controlling work site dust conditions, the method comprising:

providing a mobile dust control machine configured to treat a dust condition within a work location, the dust control machine being disposed distant from the work location;

monitoring a dust condition of the work location;

generating a dust control signal in response to monitoring the dust condition;

dispatching the mobile dust control machine to the work location in response to the dust control signal;

operating the mobile dust control machine at the work location;

wherein the mobile dust control machine is a first mobile dust control machine; and the method further comprises:

monitoring the status of a resource onboard the first mobile dust control machine; and dispatching a second mobile dust control machine to the work location in response to monitoring the status of a resource onboard the first dust control machine.

21. A dust control system for controlling work site dust conditions, the dust control system comprising:

a dust monitor disposed and arranged at the work location to monitor a dust condition of the work location and being operable to produce a dust control signal; and a mobile dust control machine configured to treat a dust condition within the work location, the dust control machine being movable to the work location from a position distant from the work location in response to the dust control signal.

22. The dust control system of claim 21, further comprising:

a mobile work machine disposed within the work location;

wherein the dust monitor is attached to the mobile work machine.

23. The dust control system of claim 21, further comprising a controller operable to receive a dust control signal from the dust monitor and being operable to produce a dispatch signal for dispatching the mobile dust control machine to the work location in response to the dust control signal.

24. A dust control system for controlling work site dust conditions, the dust control system comprising:

a dust monitor disposed and arranged to monitor a dust condition of a work location and being operable to produce a dust control signal;

a mobile dust control machine configured to treat a dust condition within the work location, the dust control machine being movable to the work location from a position distant from the work location in response to the dust control signal;

wherein the mobile dust control machine is a first mobile dust control machine; and the system further comprises a second mobile dust control machine configured to treat a dust condition within the work location, the second mobile dust control machine being movable to the work location from a position distant from the work location in response to a dust control signal generated by the dust monitor.

25. A dust control system for controlling work site dust conditions, the dust control system comprising:

a dust monitor disposed and arranged to monitor a dust condition of a work location and being operable to produce a dust control signal;

a mobile dust control machine configured to treat a dust condition within the work location, the dust control machine being movable to the work location from a position distant from the work location in response to the dust control signal;

wherein the mobile dust control machine is a first mobile dust control machine;

the system further comprises a second mobile dust control machine configured to treat a dust condition within the work location, the second mobile dust control machine being movable to the work location from a position distant from the work location in response to a dust control the dispatch signal generated by the dust monitor;

the first and second dust control machines include location monitoring equipment operable to determine locations of the first and second dust control machines, the location monitoring equipment being in communication with the controller; and the controller is operable to receive location information from the location monitoring equipment and to produce the dispatch signal in response to the location information.

26. A dust control system for controlling work site dust conditions, the dust control system comprising:

a first dust monitor disposed and arranged to monitor a dust condition of a work location and being operable to produce a dust control signal;

a mobile dust control machine configured to treat a dust condition within the work location, the dust control machine being movable to the work location from a position distant from the work location in response to the dust control signal;

wherein the work location is a first work location;

the system composes a second dust monitor disposed and arranged to monitor a dust condition of a second work location and being operable to produce a second dust control signal indicative of a dust condition within the second work location; and the mobile dust control machine is movable to the second work location from a position distant from the second work location in response to the second dust control signal.

27. The dust control system of claim 26, wherein:

the dust monitor that is disposed and arranged to monitor a dust condition of the first work location is a first dust monitor;

the dust monitor that is disposed and arranged to monitor a dust condition of the second work location is a second dust monitor; and the system further comprises a controller operable to receive dust control signals from the first and second dust monitors, compare the dust conditions of the first and second work locations, and use the comparison to produce a dispatch signal for dispatching the mobile dust control machine to the first work location.

28. The dust control system of claim 27, wherein the controller is operable to use the comparison to produce one or more dispatch signals for dispatching the mobile dust control machine to the first work location and subsequently to the second work location.

29. The dust control system of claim 27, wherein the controller is operable to communicate a dispatch signal to the mobile dust control machine.

30. The dust control system of claim 27, further including a third dust monitor disposed and arranged to monitor a dust condition of a third work location and being operable to produce a dust control signal;

wherein the controller is operable to receive a dust control signal from the third dust monitor, compare the dust conditions of the first, second, and third work locations, and use the comparison to determine a dispatch route for the mobile dust control machine.

* * * * *